United States Patent [19]

Smith, Jr. et al.

[11] 4,235,592

[45] Nov. 25, 1980

[54] AUTOCLAVE FURNACE WITH MECHANICAL CIRCULATION

[75] Inventors: Charles W. Smith, Jr., Fairview; Franz X. Zimmerman, Erie, both of Pa.

[73] Assignee: Autoclave Engineers, Inc., Erie, Pa.

[21] Appl. No.: 70,674

[22] Filed: Aug. 29, 1979

[51] Int. Cl.[3] ..... F27B 5/04

[52] U.S. Cl. ..... 432/205; 13/31 R; 219/400; 266/251; 266/252; 432/199

[58] Field of Search ..... 432/199, 205; 13/31 R; 219/400; 266/251, 252

[56] References Cited

U.S. PATENT DOCUMENTS

| | | | |
|---|---|---|---|
| 4,022,446 | 5/1977 | Smith et al. | 266/251 |
| 4,131,419 | 12/1978 | Isaksson | 432/205 |
| 4,151,400 | 4/1979 | Smith et al. | 432/199 |

*Primary Examiner*—John J. Camby

*Attorney, Agent, or Firm*—Webb, Burden, Robinson & Webb

[57] ABSTRACT

An apparatus for treating a workpiece at elevated temperatures and pressures comprising an elongate cylindrical pressure vessel. Within the pressure vessel a hearth sits upon a pedestal. Surrounding the pedestal and the workspace immediately thereabove is an insulated furnace enclosure. A cavity near the base of the pedestal defines an impeller chamber. An impeller is positioned in the chamber and has a downwardly extending drive shaft. The impeller circulates the pressurized atmosphere. A remotely actuated gate directs the circulating atmosphere to either circulate totally within the furnace enclosure or partially within the furnace enclosure and partially along the interior wall of the pressure vessel.

4 Claims, 4 Drawing Figures

AUTOCLAVE FURNACE WITH MECHANICAL CIRCULATION

There currently exist numerous uses for apparatus that treat a specimen or workpiece at high pressures and high temperatures including, for example, gas pressure bonding furnaces and hot isostatic pressing apparatus. In these apparatus, it is typical to treat a workpiece at 1000° C. and 15,000 psi although these are not the maximum temperature and pressure conditions encountered. Suitable apparatus for these applications generally comprise a furnace within a pressure vessel or autoclave. The furnace provides the heat to the workpiece and protects the vessel from excessive temperature. The vessel maintains the furnace and the workpiece at the desired pressures.

For a given pressure, the diameter of the pressure vessel determines the minimum safe thickness of the vessel wall. To avoid extremely heavy vessels, it is desirable to reduce the vessel diameter as much as possible. Stated another way, the space between the interior of the vessel lining and the workpiece should be very small even though this is the space occupied by the furnace.

In most processes, it is essential that the temperature of the workpiece be extremely uniform. Otherwise, problems may result from differential thermal expansion of the workpiece. Thus, the furnace portion of the high pressure-high temperature apparatus must distribute the heat evenly to the workpiece.

It is an advantage of this invention to provide an autoclave or pressure vessel-furnace structure that minimizes the diameter of the pressure vessel, while at the same time providing for even distribution of heat to the workpiece in a way to obtain uniform workpiece temperature.

This application is related to our U.S. Pat. No. 4,151,400 which describes mechanical circulation in an autoclave furnace.

SUMMARY OF THE INVENTION

Briefly, according to this invention, there is provided an apparatus for gas pressure bonding, hot isostatic pressing or the like in which a workpiece may be treated at elevated temperatures and pressures. The apparatus comprises an elongate cylindrical pressure vessel. The pressure vessel further comprises an insulated hood or furnace for enclosing the workpiece and a hearth upon which the workpiece rests. The hearth is set upon a refractory pedestal and a cylindrical heating element surrounds the pedestal preferably completely below the hearth. Preferably, the heating element is carbon or graphite. Other electrical resistance heating elements may be satisfactory including molybdenum or tungsten mesh. The heating element may be SiC for oxidizing atmospheres at lower power requirements. A cylindrical refractory shield may be disposed about the pedestal and heating element in a way to permit convection to transfer heat from the heating element to the workpiece placed upon the hearth.

A cavity near the base of the pedestal forms an impeller housing having radially extending exhaust ports opening out through the side of the pedestal. An impeller is positioned in the impeller chamber and has a downwardly extending shaft. Suitable means are provided for driving the shaft as by an electrical motor in the lower part of the pressure vessel. In one embodiment, the shaft passes through the bottom of the pressure vessel and enters a sealed drive unit where driven magnets are secured thereto. Suitable magnet drives are those disclosed, for example, in Ruyak U.S. Pat. Nos. 2,996,363 and 4,106,825.

The furnace is provided with a remotely actuated damper. Thus the impeller may circulate the pressurized atmosphere only within the furnace or by changing the damper position the impeller may circulate furnace atmosphere along the interior of the pressure vessel walls as well as within the furnace.

THE DRAWINGS

Further features and other objects and advantages of this invention will become clear from reading the following detailed description with reference to the drawings in which:

FIG. 1 is a section view through a furnace according to one embodiment of this invention, FIG. 2 is a plan view in section corresponding to FIG. 1, FIG. 3 is a schematic showing the circulation of furnace atmosphere totally within the furnace; and FIG. 4 is a schematic illustrating flow of furnace atmosphere along the interior of the vessel wall during cooling.

DESCRIPTION OF THE PREFERRED EMBODIMENTS

Figure 1:
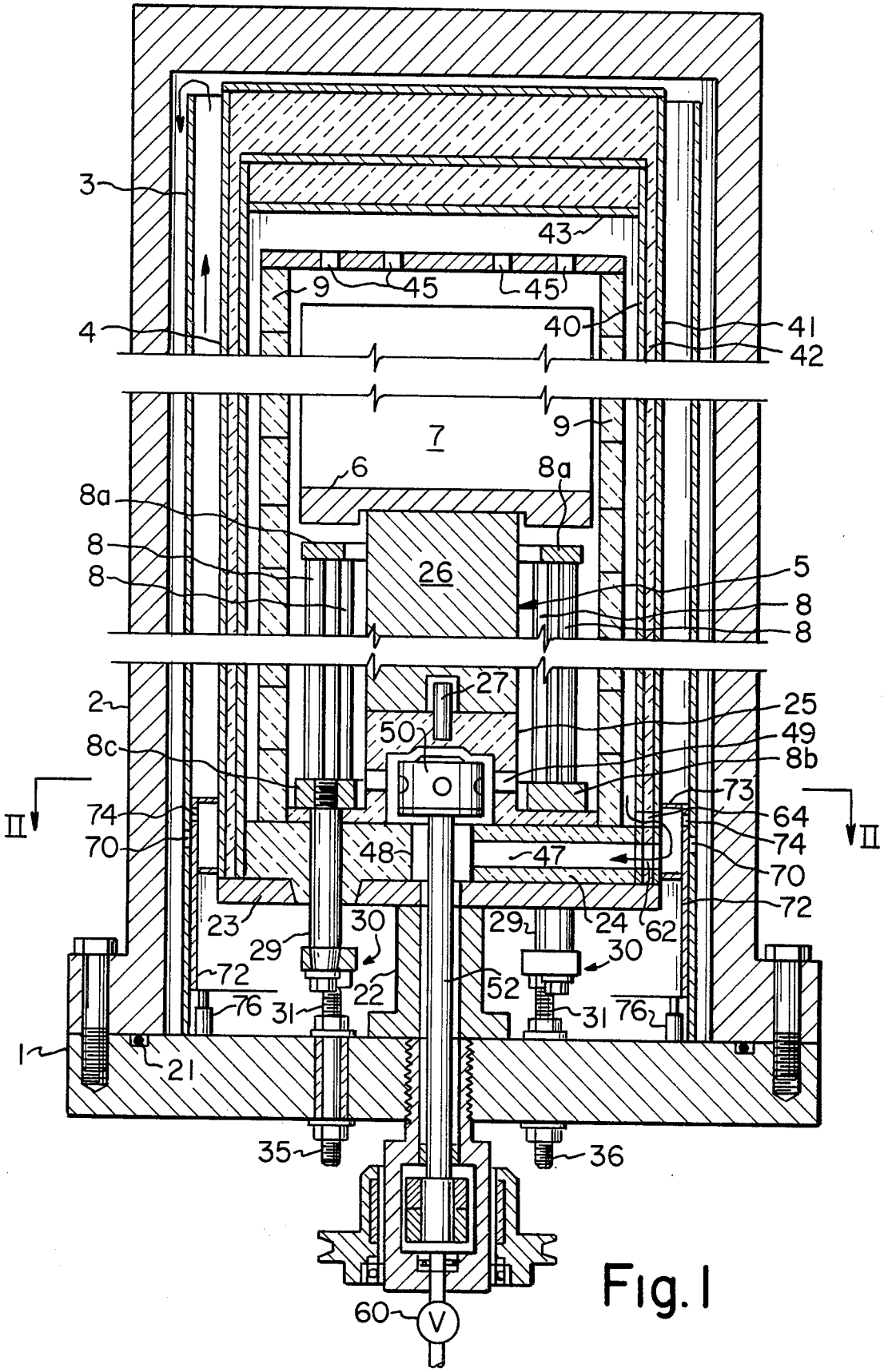
Figure 2:
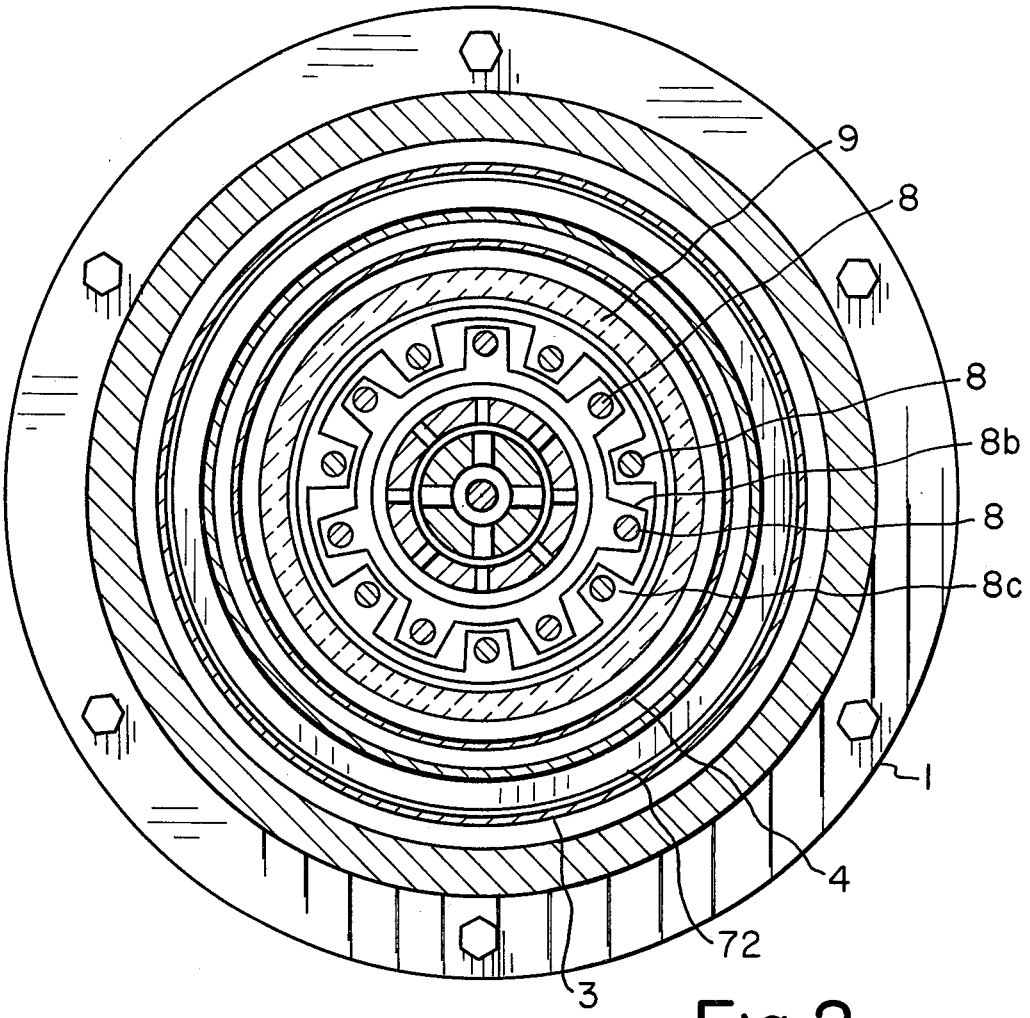

Referring to FIG. 1, there is shown a pressure vessel 1,2 arranged outside of a furnace comprising a hood 4, a shield 9, and heating elements 8. A workpiece 7 is supported upon a hearth 6 and pedestal 5. Between the furnace hood 4 and the interior of the wall of the vessel 2 is located a cylindrical baffle 3.

More specifically, referring to FIG. 1 there is shown a pressure vessel or autoclave comprising a base 1 and an inverted hat-shaped shell 2. The flange at the base of the shell is provided with openings through which fastening means enable the shell to be secured to the base. An O-ring or gasket 21 provides a pressure tight seal. The base or the shell is provided with openings (not shown) which are connected to means for pressurizing the interior of the vessel, for example, with an inert atmosphere. Pressures up to 30,000 psi are typical. The thickness of the shell depends upon the pressures to be contained and the diameter of the shell. Typically the shell is made from high strength steel.

According to the invention, a pedestal 5 supported from the base supports a hearth 6. The hearth should be strong enough to support the workpiece at working temperatures. The hearth 6 has a diameter greater than the diameter of the pedestal. This enables the base of the workpiece 7 to be greater than the top of the pedestal 5.

Preferably a hollow foot 22 supports a furnace bottom 23 somewhat above the base 1. The foot 22 and the furnace bottom 23 may be constructed of carbon steel. Setting upon the furnace bottom is heat and electrical insulating support 24 which may be made from refractory insulting or high alumina castable. On top of the support 24 is an impeller chamber block 25. A graphite, molybdenum or tungsten hearth 6 tops the pedestal extension 26. An anchor 27 fixed in the impeller chamber block engages the graphite pedestal extension to ensure alignment.

Surrounding the pedestal but not in contact therewith is a cylindrical carbon or graphite, SiC or refractory metal (e.g., molybdenum) electrical resistance heating element. The heating element may comprise a cylindrical cage of rods 8 with adjacent rods forming pairs joined at the top by caps 8a spanning each pair. Two conducting rings, one 8b with external teeth and another 8c with internal teeth are arranged around the pedestal to form bases to support the cylindrical rods 8 and to provide the pairs of rods with electrical current.

Electrical connecting means 35 and 36 are provided through the base of the vessel to supply an electrical current at an appropriate voltage level to the heating elements.

In the preferred embodiment, the furnace bottom 23, the insulating support 24 and impeller chamber block 25 have openings therein to permit graphite carbon, molybdenum or tungsten rods 29 threaded to the conducting rings 8b and 8c to pass into the space below the furnace bottom. Here means 30 couple the rods to the terminal 31 which is connected to an electrical conduit passing through the base 1.

A refractory shield 9 is provided about the periphery of the heating element. Its principal function is to prevent radiation directly outward from the heating element toward the hood 4.

The shield 9 may comprise an insulating refractory, say a lightweight insulating brick or refractory castable. The shield may also comprise a multi-shell radiation shield. The shield 9 rests upon the furnace bottom 24. The top of the shield must be vented. Holes 45 in the top of the shield are preferably centrally spaced.

Near the base of the hood 4 are two rows of openings. Each row of openings comprises a plurality of openings circumferentially spaced about the hood. The centers of the openings in one row of openings lie substantially in one plane parallel to the base of the vessel. The two rows of openings are axially or vertically spaced. Generally, the lower row of openings being return openings 62 are positioned radially outward of the intake channels 47 explained hereafter. The higher row of openings being the exhaust openings 64 are spaced above the row of return openings 62 and just above the insulating support 24.

The insulating support 24 has an axial opening 48 and intake channels 47 extending radially therefrom. Channels 47 are arranged to align with the return openings 62 in hood 4. The impeller chamber block 25 has an impeller chamber with a plurality of radial exhaust ports 49 extending therefrom. An impeller 50 is positioned within the impeller chamber and is secured to a downwardly extending shaft 52. The shaft passes through the insulating support 24, the furnace bottom 23, the foot 20 and the base 1 of the pressure vessel.

The shaft 52 passes into a sealed magnetic drive unit of the type disclosed, for example, in U.S. Pat. Nos. 2,996,363 and 4,106,825. In an alternate embodiment, the shaft 52 is driven by an electric motor positioned between the base 1 and the furnace bottom 23. In this instance, the temperature of the space below the furnace bottom must be carefully maintained at a safe operating temperature for the electric motor. Also, the electric motor requires the space between the bottom and the space to be enlarged.

Whatever means are used to turn the shaft 52, they should have a variable speed control. This will enable the circulation within the vessel to be tailored to the particular process or process stage taking place within the vessel.

Where the shaft 52 passes through the furnace bottom 23 it may pass through an axially aligned bushing in which the shaft is journaled. This is desirable where the length of the shaft, if not journaled when passing through the bottom 23, results in excessive vibrations. The impeller 50 may be of conventional "squirrel cage" design or any other suitable design. Since the impeller will be subject to high temperatures, it and shaft 52 must be made from materials that can withstand such temperatures.

Up to this point, the structure described is generally similar to that described in our U.S. Pat. No. 4,151,400 except for the hood 3, the row of intake openings 62 and the row of exhaust openings 64 in the hood. The tubular baffle 3 positioned between the interior of the wall of the vessel and the hood 4 has a plurality of openings 70 circumferentially spaced and also located radially outward of the intake channels 47 and return openings 62 in the hood.

A damper ring 72 slidable just within the baffle 3 is comprised of a thin tube of refractory metal such as stainless steel or the like. The damper ring 72 has a radial flange 73 inwardly directed at the top edge thereof. The width of the radial flange 73 is sufficient to fill the annular space between the baffle 3 and the hood 4 with sufficient clearance for easy movement of the damper ring. The damper ring 72 has a plurality of openings 74 therein near the radial flange 73. The holes are arranged to be brought into alignment with the openings 70 in the baffle 3 by updown positioning of the damper ring.

The baffle 3, like the damper ring 72, may comprise a thin tube of refractory metal as its only function is to direct the flow of the circulating atmosphere.

A plurality of solenoid operated risers 76 are positioned on the base 1 and arranged to raise and lower damper ring 72 a short distance, say 4–6 inches, when electrically deactuated or actuated as the case may be.

Figure 3:
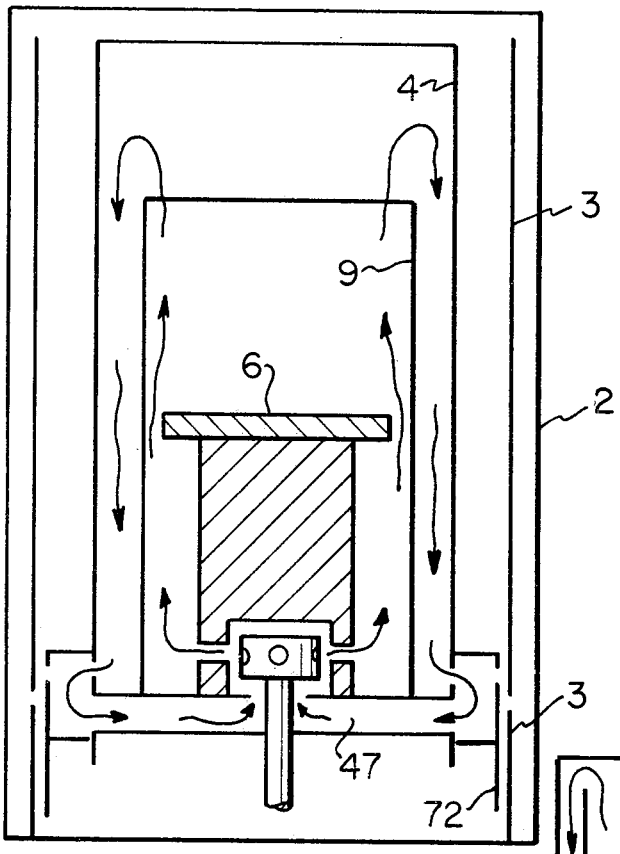

At the uppermost position of the damper ring (as shown in FIGS. 1 and 3), the furnace atmosphere is drawn down between the shield 9 and hood 4, out the exhaust openings 64 in the hood and thence are directed by the damper ring into the intake openings 62 in the hood to the intake channels 47. At this time, the openings 70 in the baffle 3 and the openings 74 in the damper ring are not aligned.

Figure 4:
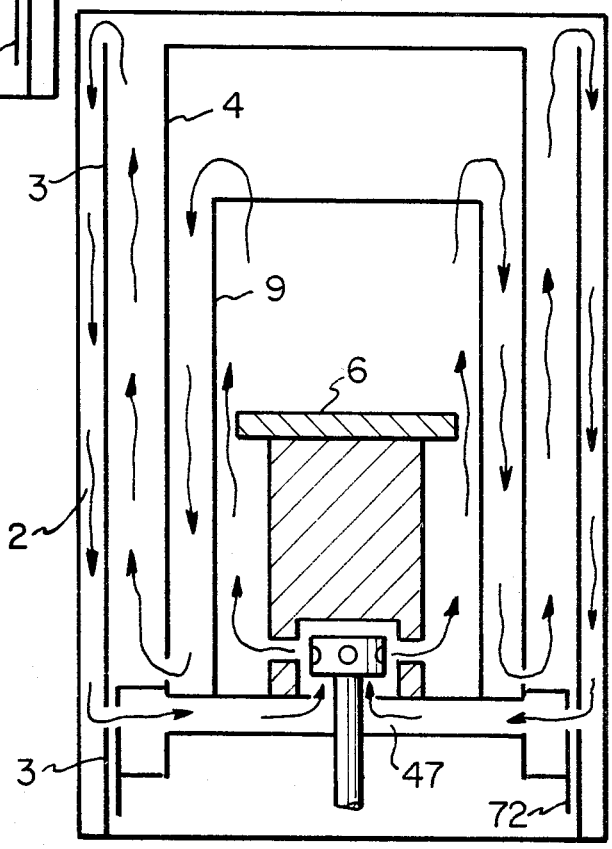

At the lowermost position of the damper ring (as shown in FIG. 4), the furnace atmosphere is drawn down between the shield 9 and hood 4, out exhaust openings 64 in the hood. Then the atmosphere is directed by radial flange 73 up between the hood 4 and the baffle 3. Then it is drawn down between the baffle 3 and the interior of the vessel wall 1. The atmosphere is then drawn through aligned openings 70 in the baffle 3 and openings 74 in the damper ring 72 and into the intake opening 62 and intake channel 47.

When the impeller 50 is rotated it draws in the furnace atmosphere or gases along the impeller shaft 52 and forces the gases radially outward into the space between the pedestal wall and the shield 9 in the vicinity of the heating elements 8. The gases are heated passing by the heating elements (assuming they are heated at the time) and forced into the space above the hearth 6 where they transfer heat to the workpiece. Thereafter, the gases pass between the shield 9 and the hood 4. The return path then depends upon the position of the damper ring as already explained.

The insulating hood 4 is the principal heat insulation separating the workpiece and the heating element from the pressure vessel shell. The hood is designed to minimize heat transfer to the shell and to have a low heat capacity. A number of hood designs are possible. One shown in FIG. 1, comprises a stainless steel inner lining 40 and a carbon steel outer lining 41 with ceramic fiber heat insulation 42 therebetween. Other hood structures might comprise no inner sheet and refractory insulating brick in place of the fibers. An additional axial heat shield 43 may be placed at the upper end of the hood for best results. It should be a refractory metal such as Inconel. As with the pedestal, the less heat energy absorbed by the hood, the more available for raising the temperature of the workpiece. Hence, the heat capacity of the hood should be minimized.

The heating element or elements according to this invention are located completely below the workpiece and thereby do not occupy space between the workpiece 7 and the hood 4. This enables the diameter of the hood and therefore the shell to be reduced with the advantages described above.

Having thus described the invention in the detail and with the particularity required by the Patent Laws, what is desired protected by Letters Patent is set forth in the following claims.

We claim:

1. An apparatus for gas pressure bonding, hot isostatic pressing or the like in which a workpiece may be treated at elevated temperatures and pressures, said apparatus comprising an elongate cylindrical pressure vessel for enclosing a furnace, a furnace bottom and an insulating hood resting upon the furnace bottom for enclosing the workpiece and a hearth upon which the workpiece rests, a cylindrical baffle positioned between the interior wall of the pressure vessel and the insulating hood, an elongate cylindrical refractory pedestal extending upward from the furnace bottom, said hearth set upon said refractory pedestal, a cylindrical heating element disposed about and substantially along the entire length of said pedestal below said hearth, a cylindrical shield disposed about the pedestal and heating element, said heat sheild extending up from the furnace bottom and above the hearth, said pedestal having an impeller chamber adjacent the base thereof with radial exhaust ports extending therefrom and an impeller positioned in said chamber having a downwardly extending drive shaft, and remotely actuatable damper means for directing the flow of the furnace atmosphere moving in response to the action of the impeller such that in a first position of the damper means flow is directed entirely within the furnace hood and in a second position flow is directed from the furnace interior to flow between the baffle and interior of the vessel wall prior to returning to the impeller.

2. An apparatus for gas pressure bonding, hot isostatic pressing or the like in which a workpiece may be treated at elevated temperatures and pressures, said apparatus comprising an elongate cylindrical pressure vessel for enclosing a furnace, a furnace bottom, an insulating hood resting upon the furnace bottom for enclosing the workpiece and a hearth upon which the workpiece rests, a cylindrical baffle having openings therethrough near the bottom thereof, said baffle positioned between the interior wall of the pressure vessel and the insulating hood, an insulating support rests upon the furnace bottom having an axial opening and intake channels extending radially therefrom, an elongate cylindrical refractory pedestal having a base resting over the axial opening in the insulating support, said hearth set upon said refractory pedestal, a cylindrical heating element coaxial with said pedestal and resting on the insulating base, a cylindrical shield disposed about the pedestal and heating element upwardly from the furnace bottom, said heat shield extending up from the furnace bottom and above the hearth, said heat shield having openings therethrough near the bottom thereof, said pedestal having an impeller chamber adjacent the base thereof and in communication with the axial opening in the insulating support with radial exhaust channels extending therefrom and an impeller positioned in said chamber having a downwardly extending drive shaft, a remotely actuatable damper means comprising a cylindrical shutter with a radial flange positioned between the hood and the baffle for directing flow of the furnace atmosphere moving in response to the action of the impeller such that in a first position of the damper means the openings in the baffle are closed off and flow is directed entirely within the furnace hood and in a second position the openings in the baffle are open and flow is directed from the furnace interior to flow between the baffle and interior of the vessel wall prior to returning to the impeller.

3. The apparatus according to claims 1 or 2 wherein solenoid actuated devices move the damper means between first and second positions.

4. The apparatus according to claim 2, wherein the damper means comprises a cylindrical portion and a radial flange attached thereto and means for remotely actuating the damper means to a first position with the cylindrical portion covering the holes in the baffle and the radial flange preventing flow upward between the baffle and hood as it emerges from the openings near the bottom of the hood and for remotely actuating the damper means to a second position with the cylindrical portion uncovering holes on the baffle and the radial flange preventing flow downwardly between the baffle and hood as it emerges from openings near the bottom of the hood.

* * * * *